US005921320A

United States Patent [19]

Shulyatikov et al.

[11] Patent Number: 5,921,320

[45] Date of Patent: Jul. 13, 1999

[54] PROCESS AND DEVICE FOR RAISING LIQUIDS FROM WELLS

[76] Inventors: Vladimir Igorevich Shulyatikov, B. Cherkizovskaya str., 6-7-21, Moscow, 107061, Russian Federation; Alexei Vladimirivich Shulyatikov, Borisovskie Prudy str., 15-2-31, Moscow, 115408, Russian Federation; Igor Vladimirivich Shulyatikov; Svetlana Vitalievna Shulyatikov, both of B. Cherkizovskaya str., 6-7-21, Moscow, 106061, Russian Federation

[21] Appl. No.: 08/764,302

[22] Filed: Dec. 12, 1996

Related U.S. Application Data

[63] Continuation of application No. PCT/RU94/00129, Jun. 17, 1994.

[51] Int. Cl.[6] ..... E21B 43/00

[52] U.S. Cl. ..... 166/372; 166/177.3

[58] Field of Search ..... 166/369, 372, 166/177.3; 92/162 P

[56] References Cited

U.S. PATENT DOCUMENTS

| | | | |
|---|---|---|---|
| 3,500,933 | 3/1970 | Burba, Jr. et al. | 166/177.3 X |
| 4,813,485 | 3/1989 | Coyle | 166/372 |
| 5,462,115 | 10/1995 | Belden et al. | 166/177.3 |
| 5,620,314 | 4/1997 | Worton | 92/162 P |

FOREIGN PATENT DOCUMENTS 1377456 2/1988 Russian Federation .

OTHER PUBLICATIONS

Sukhonosov, G.D., Ispytanie Neobsadnykh Skvazhin, 1978, Izdatelstvo "Nedra", p. 33, Moscow (See English Abstract).

Muraviev, I.M., Exploatatsiya . . . , pp. 210–213, (1949) Moscow–Leningrad (See English Abstract).

*Primary Examiner*—William P. Neuder
*Attorney, Agent, or Firm*—Michael N. Meller

[57] ABSTRACT

The invention relates to the gas and oil producing industry and can be used in raising liquids from oil, gas and gas condensate wells. The process for raising liquids from wells involves periodically lowering a lowerable assembly into a tubing string and, subsequently lifting same with a column of liquid above it. Between the lateral surface of the lowerable assembly and the walls of oil well tubings is maintained a ring-shaped gap of constant width, while a lifting operation is carried out at definite speed when some of the gas from the well will pass through the ring-shaped gap from bottom to top preventing the liquid from flowing downwards. The device for raising liquids from wells includes a hoist with a cable, a tubing string and a lowerable assembly placed inside the string with a non-shaped valve fitted with centralizers and securely fastened to the said hoist cable. The lowerable assembly and its non-return valve can be embodied in a plurality of structural variations of the invention. The process and device as claimed make it possible to reduce power consumption for raising liquids from wells by using the pressure of blanket and/or injected gas without a particular sophistication of the lowerable device.

13 Claims, 8 Drawing Sheets

PROCESS AND DEVICE FOR RAISING LIQUIDS FROM WELLS

This application is a continuation of PCT/RU94/00129 filed Jun. 17, 1994.

FIELD OF THE INVENTION

This invention relates to the extraction of gas, oil and liquids from wells and more particularly to a process and device to control and remove liquids from oil, gas and gas-condensate wells.

BACKGROUND OF THE INVENTION

A prior art method is taught in USSR Inventor's Certificate Specification No. 1260716 for swabbing wells according to which, a heavy swab is run into a well on a hoist cable. Under the influence of its weight the swab goes down in the well and it is sunk below fluid level. The depth of immersion of the swab in the liquid is monitored after which the swab is raised back together with the column of liquid lying above it. This cycle is repeated. After several cycles, when the fluid level in the well ceases to drop, a well production rate is determined. This method can be used during well completion, trial operation or for cleaning out the near-bottom zone of oil and water from the wells.

The shortcomings of the aforementioned patented method consist in its high power consumption, the necessity for using a powerful hoist and a cable of large diameter. These requirements impose physical constraints which limit the utility of this method. It is the weight of the swab and hoist cable that makes up the considerable part of the weight being raised which leads to a reduction in the coefficient of useful utilization of the hoist capacity. In addition to this, the possibility of a gas breakthrough from the formation, when the liquid is being raised, requires the construction of the lowerable assembly to be more complicated, in order to prevent the latter from being jammed and to avert a breakdown of the drive means. It is also dangerous to make use of this method in the wells of gas fields and gas condensate fields.

Another prior art device for raising a liquid from wells, either flooded or gas producing ones, is taught in USSR Inventor's Certificate Specification No. 1161720. The device taught in this patent comprises a hoist, a cable, a lift tubing string, and a plunger which is accommodated inside the string and fastened to the cable. In order to prevent leakages of the liquid, when being raised, this plunger is provided with a sealing and the device includes a special breaking gear in order to prevent it from jamming in case of a gas breakthrough from the formation.

After the raised liquid begins to overflow into the horizontal pipeline located on the surface of the ground, the back pressure on the gas below the device decreases causing the gas to expand. The sealing of the plunger sealing hinders the outflow of gas, and the device gets accelerated to a high speed similarly to a shell accelerating in a gun barrel under the influence of gas pressure when the powder is burning therein. As a result, the flexible pulling member fails, and the device may get jammed in the lift tubing string or destroy the well head equipment by striking it, since the device has a heavy weight. So, operational reliability of the device is accompanied by a substantial complication of its construction.

SUMMARY OF THE INVENTION

The claimed method and device enable one to reduce power consumption for lifting liquids from wells owing to the use of blanket and/or injected gas (gas lift), without complicating much of the construction of the lowerable assembly.

The method provides for periodically lowering a lowerable assembly into a tubing string, sinking same below the fluid level, raising of the lowerable assembly together with a column of liquid above it, wellhead overflow and withdrawal to a gathering system. The lowerable assembly is selected with a diameter smaller than the internal diameter of oil well tubings and is fitted with centralizers, a factor that allows one, during a round trip, to maintain a ring-shaped gap of constant width between the lateral side of the lowerable assembly and the walls of said oil well tubings. Under specific conditions as described hereinbelow, the lowerable assembly will be raised together with a column of liquid above it by using the pressure of blanket or injected gas (gas lift) and, along with this, some of the gas (further designated $Q_{d.ch}$·) will be passing through the ring-shaped gap from bottom to top, preventing the liquid from flowing downwards. The area of said ring-shaped gap make up to 25% of the flow area of the oil well tubing.

The lowerable assembly together with a column of liquid above it is raised at a rate defined by the following ratio:

$$\frac{Q_1}{F} < V < \frac{Q_1 + Q_g + Q_{d.ch\cdot}}{F},$$

wherein

V—the rate of raising a lowerable assembly, m/sec;

F—the flow area of an oil well tubing, m2;

$Q_1$—a liquid flow rate, m3/sec;

$Q_g$—a gas flow rate, m3/sec;

$Q_{d.ch}$·—the dynamic characteristic of a device, m3/sec, meaning a gas discharge, the least required for retention without leakage of a column of liquid above a ring-shaped gap.

Volume indices are given for a real operating pressure which changes during the process.

If a hoisting speed is below the admissible, liquid entry into a well occurs at higher speed and the well grows blind. If the speed exceeds the admissible, the gas pressure will not retain a column of liquid, which will cause a sharp increase in loading on the hoist down to the cable breakage.

Also, a well flow rate as to liquid and gas may be known already by the previous well operation prior to the initial use of the method described. If the well flow rate is not known or it may require to be specified, then the well flow rate is established after several cycles of lowering and raising a lowerable assembly when the fluid level in the well ceases to drop and remains constant during two-three successive cycles.

In the latter case, the lowerable assembly in the initial cycles of operation, before a well flow rate will have been determined, is raised at an optional rate that also can fall into said range, albeit at random.

The dynamic characteristic of a device, Qd.ch., depends on the area of ring-shaped gap between the lowerable assembly and the walls of oil well tubings and also on the liquid and gas recovered, but is not dependent on a height of liquid column to be raised from the well.

The dynamic characteristic can be determined during the rig trails of lowerable assemblies with different liquids and gases with the area of ring-shaped gap varied, and along with this, the process can directly be observed through the transparent walls of stand pipes. The results obtained are executed in the form of tables (tabulated) or nomographs and may be included in the shipping documents of the device.

Nevertheless, the dynamic characteristics of a device can also be defined directly on the well, for which purpose a lowerable assembly is immersed for a maximum depth and started to be raised gradually. The gas pressure in a hole clearance and/or in a wellhead is controlled all the time, say, using a recording instrument. When a discontinuity appears on a pressure variation smooth curve, this goes to show that the lowerable assembly has separated the upper part of a liquid column and rises along oil well tubings together with the liquid. The gas flow from the well, measured at the instant corresponding to the break-over point of curve of the pressure variation is just the value Qd.ch.-the dynamic characteristic of the device. The broader the ring-shaped gap, the greater is Qd.ch. and the lesser must be the hoisting speed. The height of the liquid column raised depends on the pressure of blanket gas and/or injected gas.

In case where the hoist construction does not provide for a possibility of speed being regulated and the fixed speed does not fall into said range, it is possible to change the dynamic characteristic of a device and achieve the required ratio by adjusting the width of ring-shaped gap, say, by selecting the specific diameter of the lowerable assembly.

With liquid lifted at said speed there is no need for a powerful hoist and a cable of increased strength, because the lifting takes place mostly on account of gas pressure. In general the disclosed process combines the principles of operation of a piston and a gas lift (Applicant uses the term "combigas lift"). The weight of the lowerable assembly itself may be very small, in which particular case, during lowering, a gas flow from the well is restricted or shut off completely so that it does not impede the lowering operation.

During hoisting, when the top part of a liquid column reaches the wellhead and starts overflowing, the pressure of the liquid column drops, while a gas volume is increased accordingly, the hoisting speed can somewhat be increased as well.

Lifting of a lowerable assembly down to the welthead is not required, because the remaining lower part of a liquid column can be displaced by the gas from the well even without using the lowerable assembly. Depending on gas pressure, the lift of said lowerable assembly is stopped, when this or that part of the liquid raised flows over the wellhead, but usually no less than 10% of the height of the column of liquid raised.

The assembly under consideration may be started in a subsequent cycle until the liquid flow over the wellhead stops in the preceding cycle.

The well is fitted with a tubing string, 1000 m long, the internal diameter of 0.062 m and with a hoist having a load capacity of 150 kg making it possible to lift a lowerable assembly at a running speed of 0.3 m/sec, A gas flow rate is 2000 m3/day in normal conditions, and a liquid inflow is less than 10–4 m3/sec. The pressure in the bottom part of the well is 1,6 MPa. According to a nomograph of the dynamic characteristics of a device, plotted by stand test results, it has been established that with the width of a ring-shaped gap of 2 mm the lowerable assembly can be raised with a column of liquid at a speed exceeding 0.03 m/sec but not exceeding 0.43 m/sec (Qd.ch.=1,1. 10–4 m3/sec). For lifting the liquid, use was made of a lowerable assembly having a diameter of 0.058 m, with the area of said gap of 12% of the sectional area of the oil well tubing. In one cycle, a column of liquid raised was about 100 m (about 300 kg).

DESCRIPTION OF THE PREFERRED EMBODIMENTS

Figure 1:
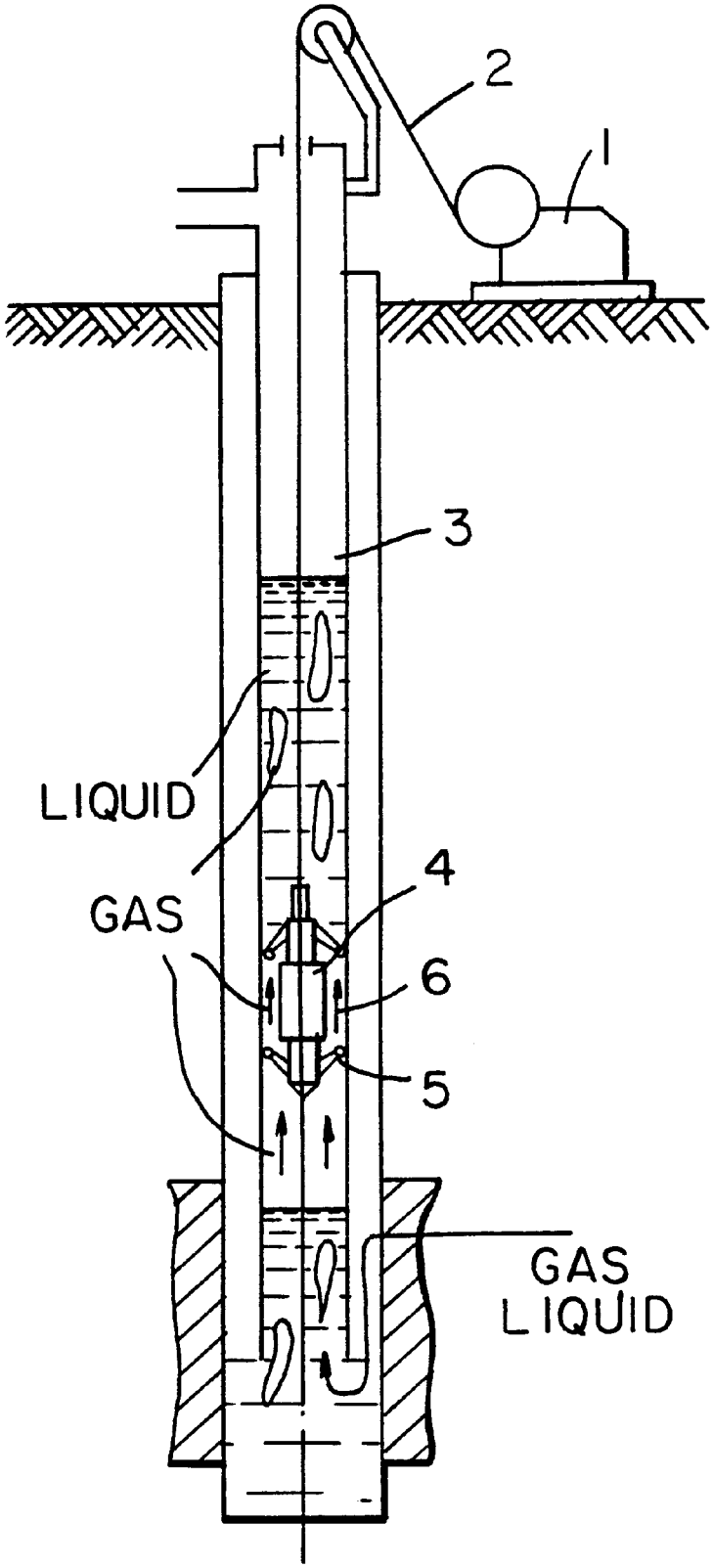
FIG. 1 shows a device for raising a liquid from a well with the device attached to a cable and lifted by a hoist, according to the invention.

A device of the type used for lifting liquids from wells (FIG. 1) comprises a hoist 1 with a cable 2 and a tubing string 3 with a lowerable assembly 4 placed therein and provided with a non-return valve (not shown in FIG. 1) and centralizers 5. The latter may be present in the top or bottom part of the lowerable assembly 4 and also distributed at different levels thereof. Said assembly 4 is attached to said cable 2 of the hoist 1. Between the walls of the tubings 3 and the lateral surface of said assembly 4 there is left a ring-shaped gap 6.

Figure 2:
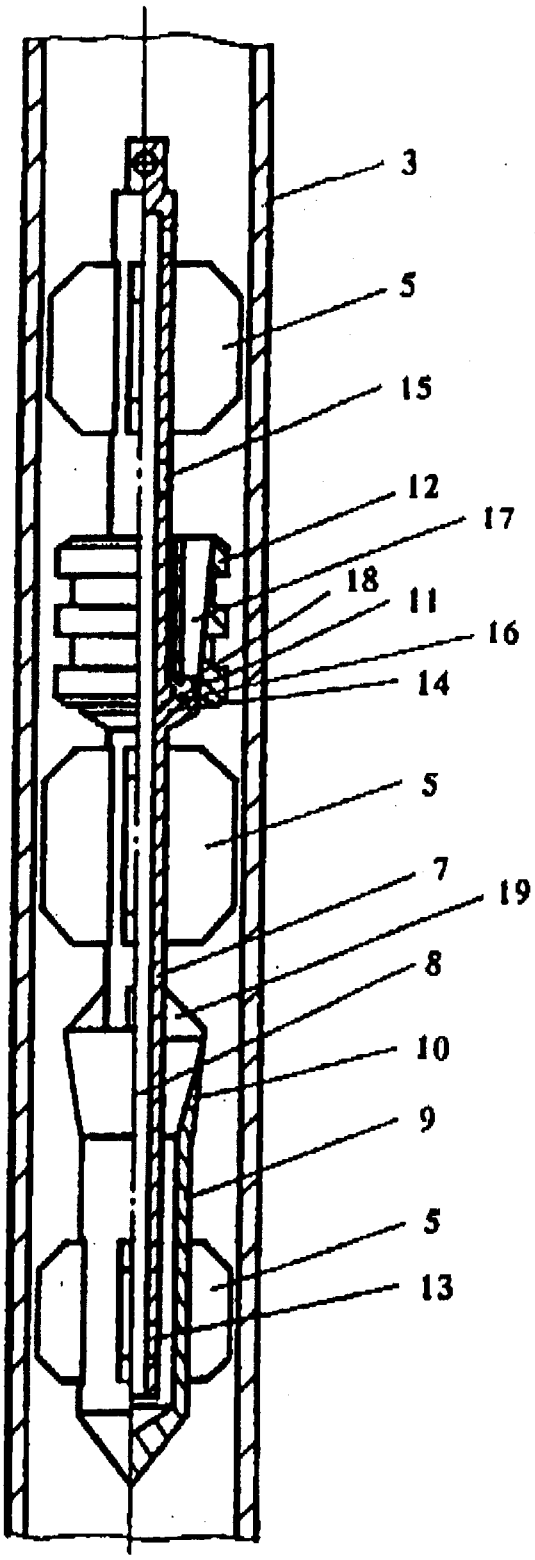
FIG. 2 shows an alternative embodiment of the device for raising a liquid, according to the invention.

The lowrerable assembly 4 may be embodied in several structural variations. Accoding to one of them (FIG. 2),the lowerable assembly is a bar 7 with an axial channel 8. The lower portion of the bar 7 is embrased by a storing device 9 in the form of a cylindrical cup with a bell 10. A non-return valve is configured as a ring-shaped limiter 11 projecting on the surface of the bar 7, over which is provided an annular reversing nozzle 12 with a faculty of movement along the bar 7. The axial channel 8 of the bar 7 has side passegeways 13–15 into said storing device 9, onto the outer surface of the limiter 11 and, in the top part, into the interior space of said tubings 3 respectively.

The outer surface of the limiter 11 and the surface of the reversing nozzle 12 that is in engagement therewith are conical. The surface of said limiter 11 having a circular recessed area 16 connected via the side passageway 15 with the axial channel 8 of the bar 7, said reversing nozzle 12 having through-going channels 17 extending along the axis or aslant thereto which originate opposite to said circular recessed area 16 on the surface of the limiter 11.

On the conical surface of the reversing nozzle 12, opposite to the circular recessed area 16, on the limiter 11 there can be made a counter circular recessed area 18.

The storing device 9 may be connected to the lower end of the bar 7 of the lowerable assembly 4 or else with the bar 7 through girthes 19 attached to the bell 10.

Figure 4:
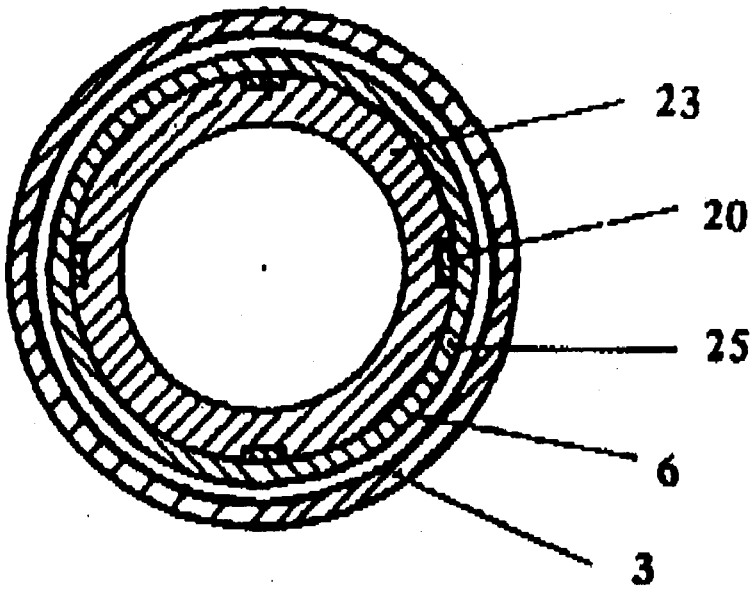
FIG. 4 shows a cross-section along line A—A in FIG. 3, according to the invention.
Figure 6:
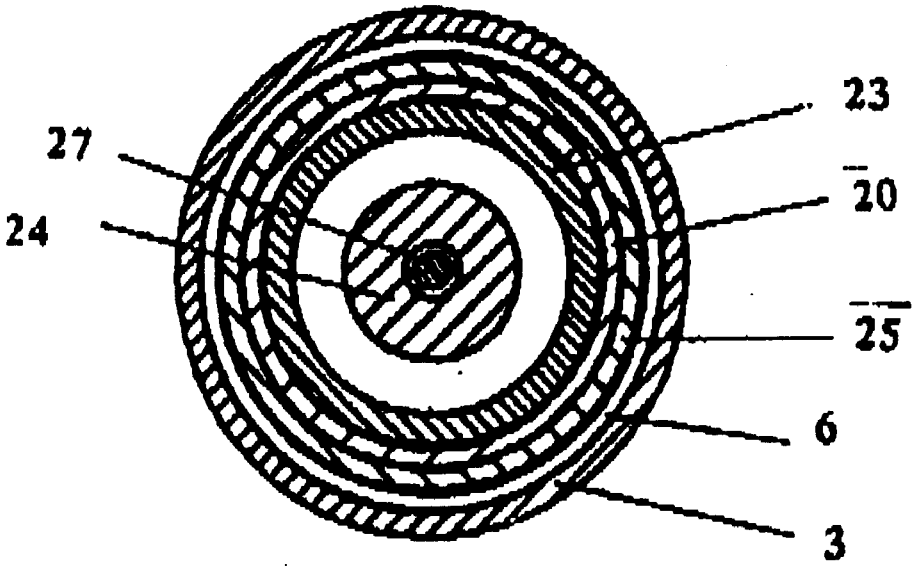
FIG. 6 shows a cross-section along line b—b in FIG. 5 according to the invention.

In alternative embodiment a lowrable assembly has a lattice body portion 20 (FIGS. 2,4) or a tubular body portion 21 (FIGS. 5,6) with longitudinally extending slots 22 and a non-return valve is made as a bush 23 and a float 24 accommodated inside the body portion, said body portion being covered, at the level of the bush 23, with an outer solid ring 25.

Figure 3:
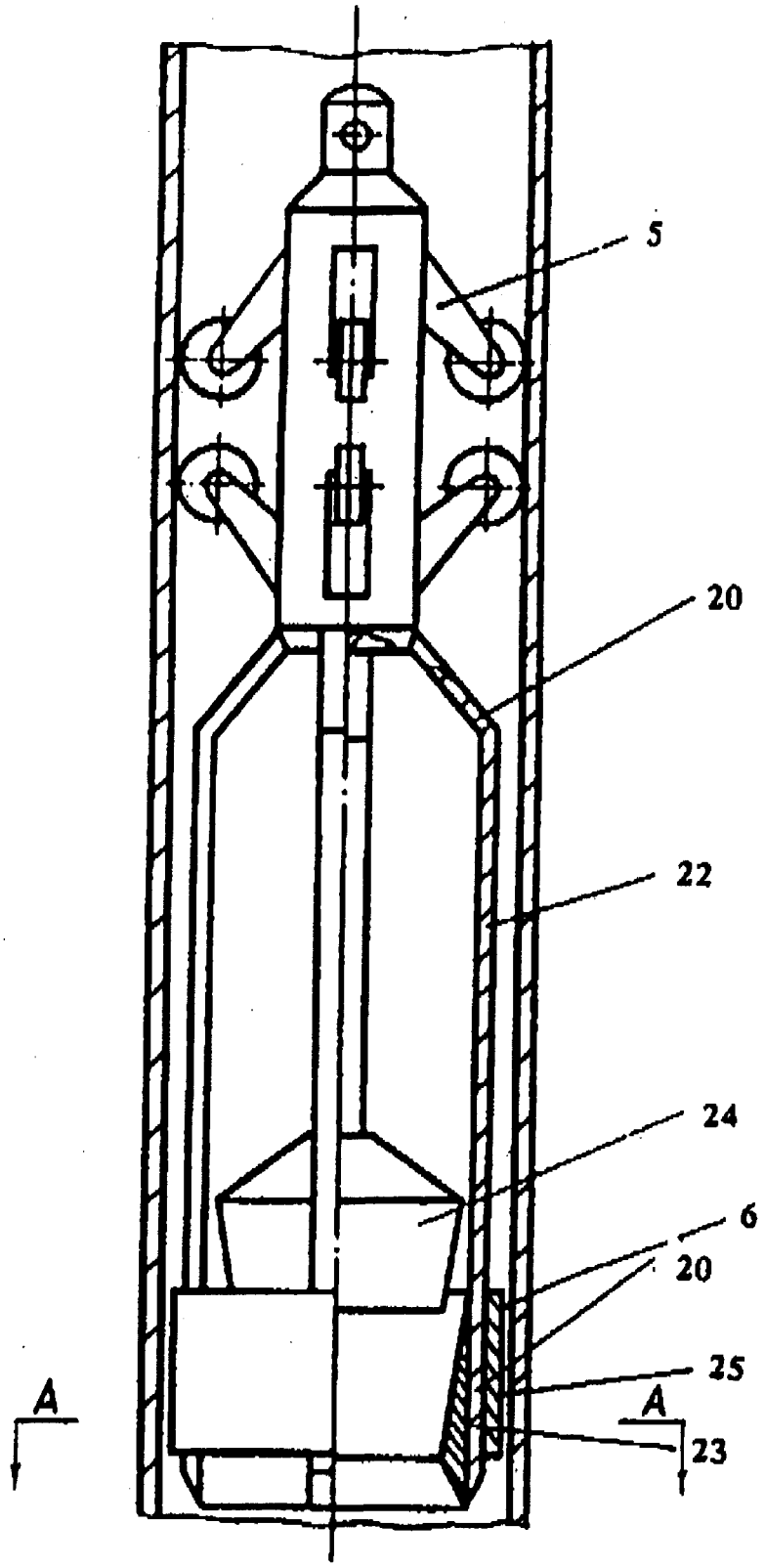
FIG. 3 shows an alternative embodiment of the device having a cantilever arrangement for the reverse extension of the check valve, according to the invention.

The diameter of the float 24 can be either greater or sightly smaller than the diameter of the opening of said bush 23. In the former instance, the float 24 freely rests on the bush 23, say, with the lateral conical surface thereof against the conical surface of the bush opening (FIG. 3). In the latter instance, the body portion of a lowerable assembly is further provided with a spring limiter 26, and along with this, in statics, the float 24 is accommodated in the bush 23 either suspended from said spring limiter 26 (FIG. 7) or freely resting on same (FIG. 8), depending on the positioning of the spring limiter 26: above or below the bush 23.

Figure 5:
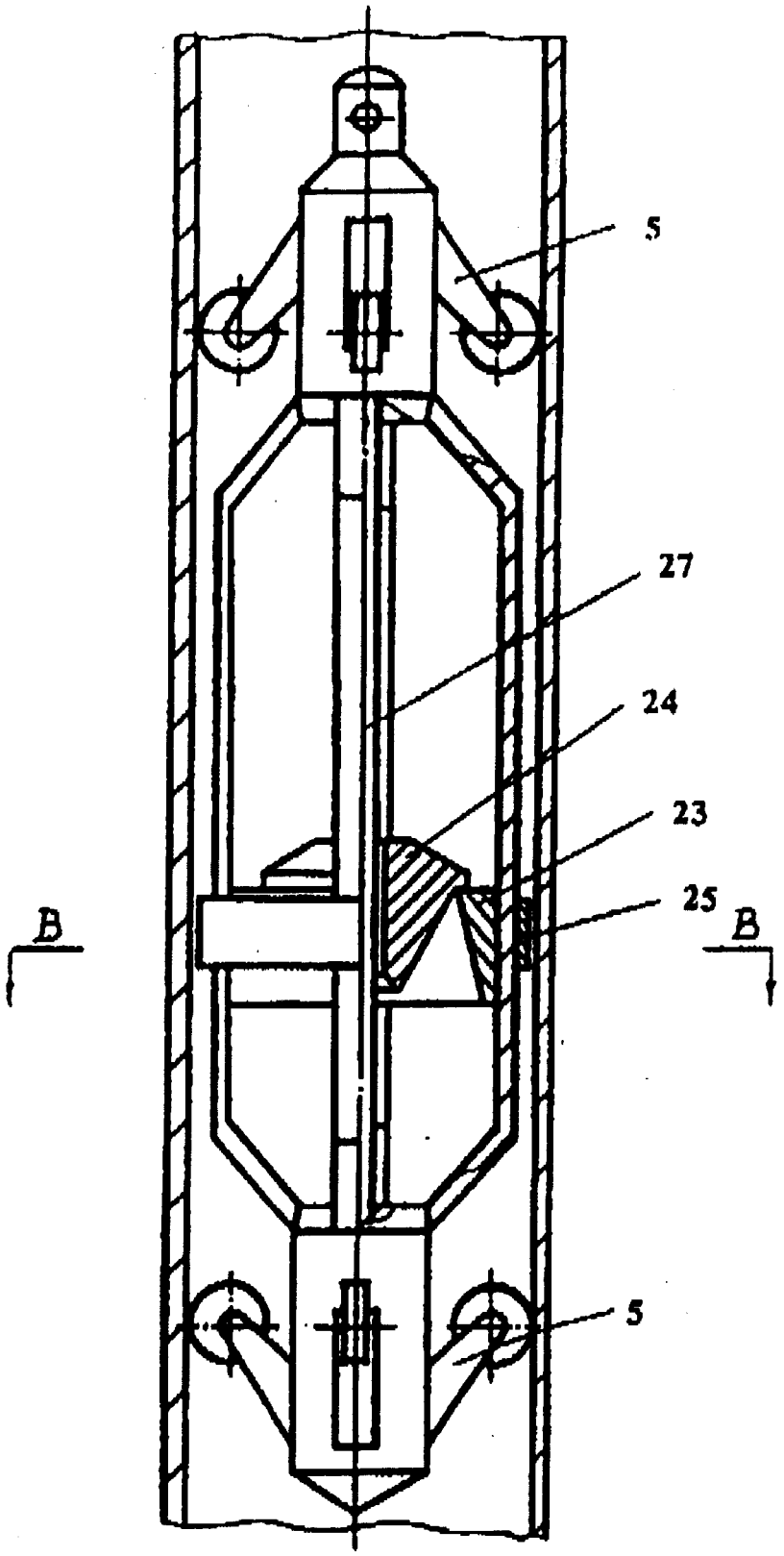
FIG. 5 shows another alternative embodiment of the device for raising a liquid from a well according to the invention.
Figure 7:
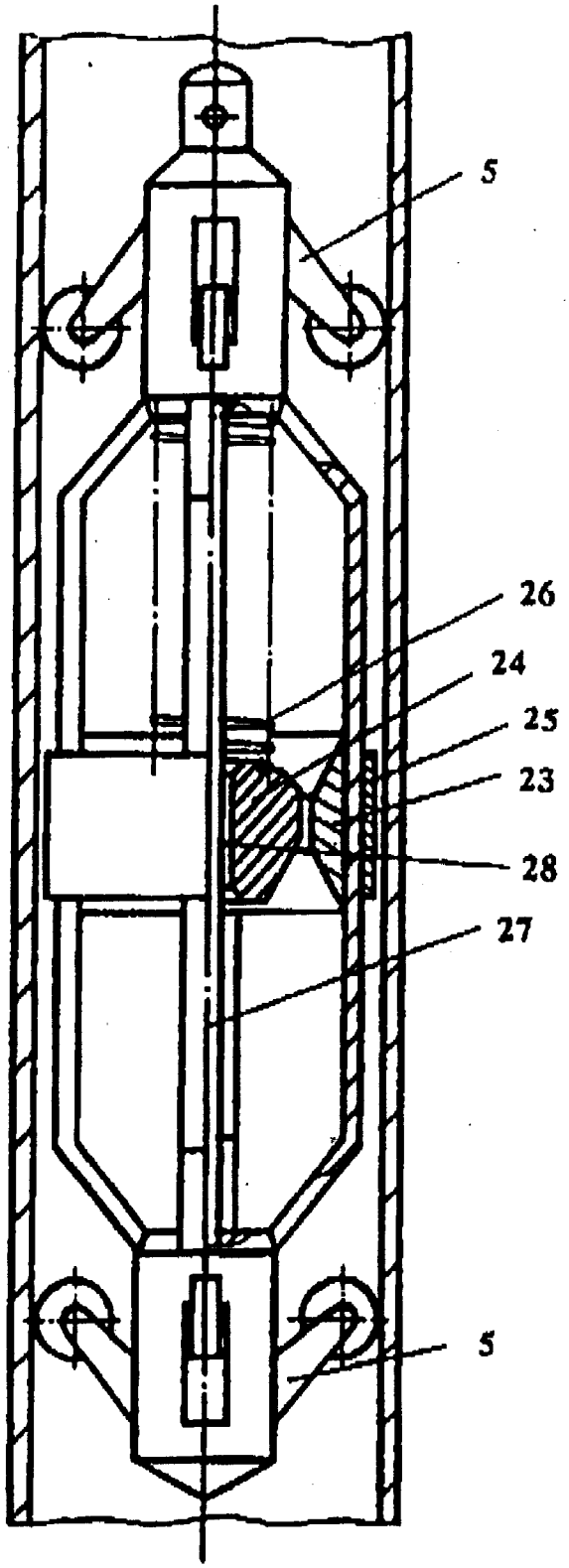
FIG. 7 shows a third alternative embodiment of the device, according to the invention.
Figure 8:
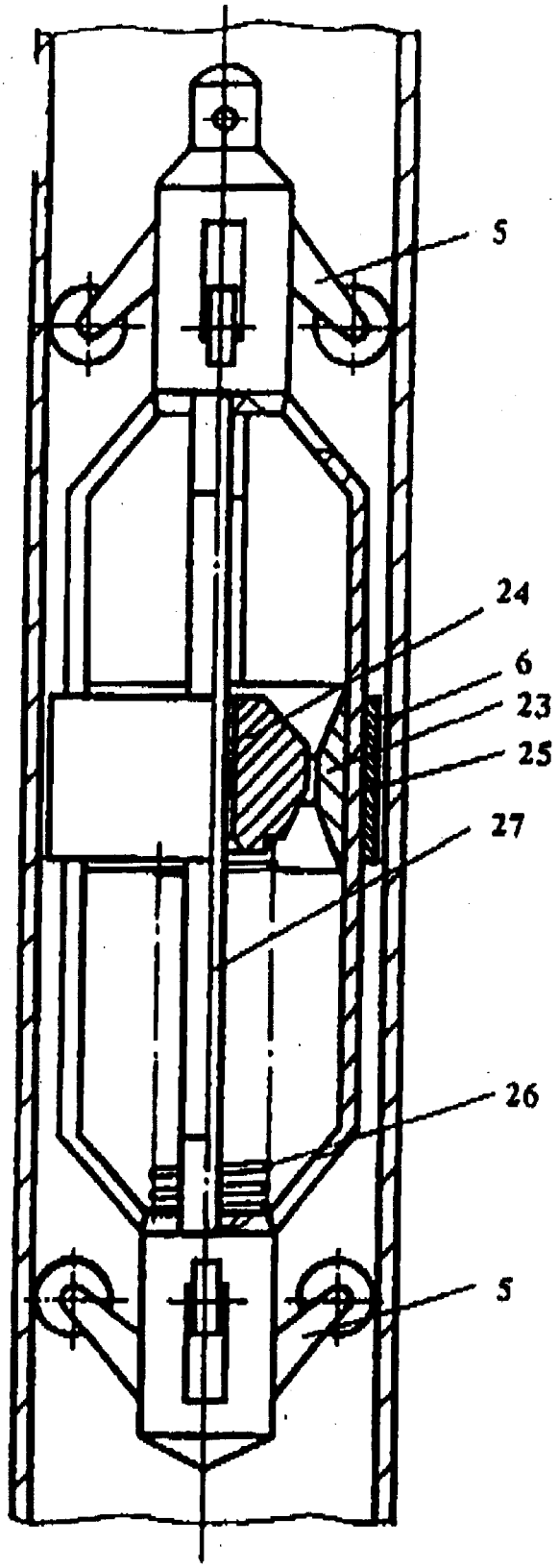
FIG. 8 shows an alternative embodiment of the device having a lower resilient member limiting for the movement of the float closing the check valve, according to the invention.

For the float 24 not to be twisted and/or blocked up in the body portion during operation, there is mounted a guide rod or rope 27 about the axis of the body portion and through axial hole 28 is made in the float 24, the latter being strung onto said guide rod 27 (FIGS. 5,7,8).

Figure 9:
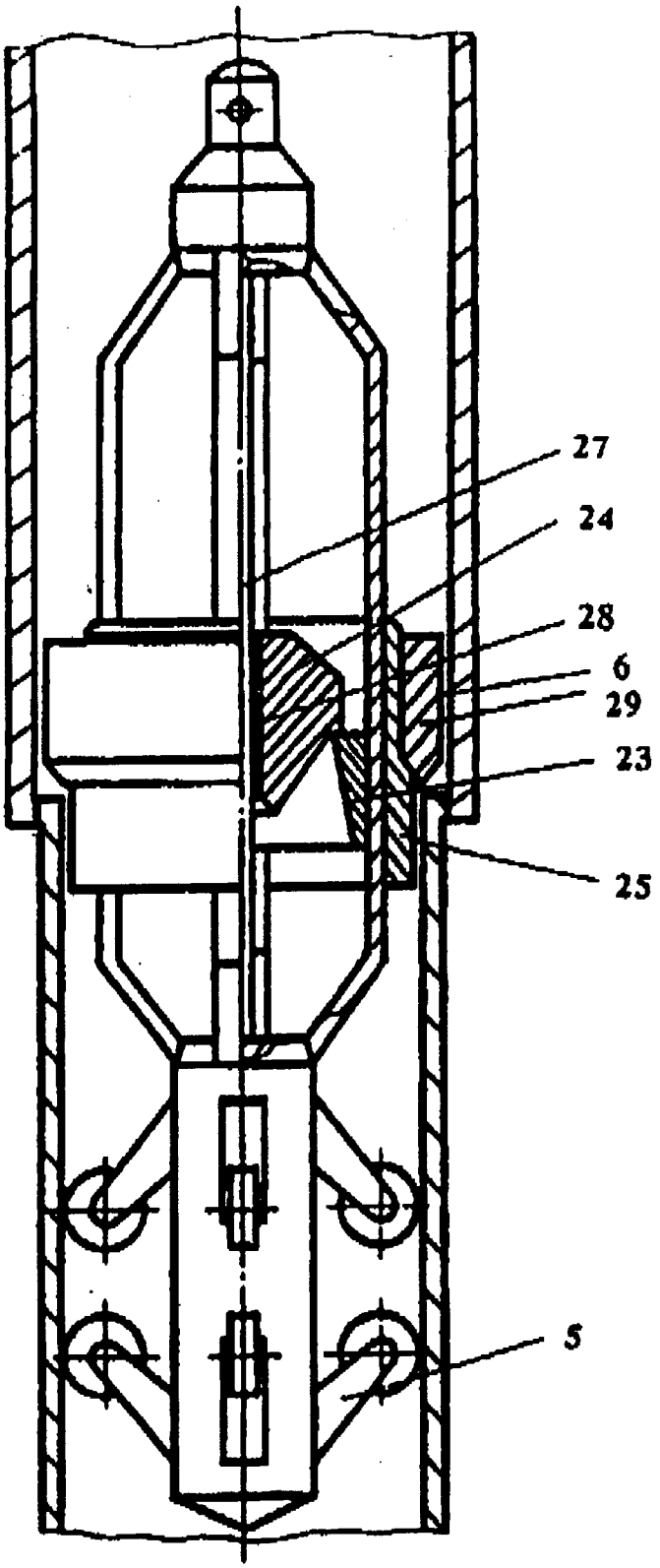
FIG. 9 shows an alternative embodiment of the device having an assembled reverse extension, according to the invention.

In deep wells, for reducing the weight of the tubing string 3 use is made of the lower oil well tubings having a diameter that is smaller than the upper ones. Transition from the tubes of one diameter to another occurs in a stepwise manner and there can be several such transisions for one well. For similar cases, on a lowerable assembly above the outer solid ring 25 are mounted additional adjusting rings 29 with freedom to slide upwards, whose number is equal to that of stepwise transitions of the diameter of the tubings while the thickness of each and every subsequent one is equal to a change in the radius of the tubings with the corresponding stepwise transition (FIG. 9). The additional adjusting rings 29 can also be used with the invariable diameter of the tubings 3 to adjust the width of the ring-shaped gap 6.

For greater obviousness, the proportions of representation of the parts of the device have been altered.

OPERATION OF THE DEVICE

The lowerable assembly 4 is attached to the cable 2 of the hoist 1 and lowered in the tubing string 3. The centralizers 5 maintain, between said assembly 4 and the walls of the tubings 3 the ring-shaped gap 6 of invariable width.

During the running-in at low speed and with a small flow of gas from the well, the annular reversing nozzle 12 is resting on the limiter 11. Given another design of the lowerable assembly the float 24 leans against the bush 23 or is placed inside the bush 23, with the spring limiter 26 taking up neutral position. As the running speed is increased, the reversing nozzle 12 or the float 24 are raised a little thereby to pass a liquid into a space above the lowerable assembly, and more importantly, the liquid is also passed through the ring-shaped gap 6 and under the reversing nozzle 12 into the axial channel 8, the side passage-ways 13–15, the circular recessed areas 16–18 and the through-going channels 17 or inside the body portion 20, 21 through the opening of the bush 23.

After a lifting operation has been started the reversing nozzle 12 or the float 24 are again returned to a position which leaves only the ring-shaped gap 6 for the passage of gas and liquid.

The present invention provides for raising a column of liquid from the well practically with no losses; nevertheless, the liquid slightly percolates through the ring-shaped gap 6 because of a spread of the diameters of the oil well tubings 3 within limits and most importantly, all of the seeping liquid or a greater part there of will he trapped by the storing device 9 with the aid of the bell 10.

In case of a gas blowout from the well and/or a sharp reduction of its flow, the spring limiter 26, when compressed or expanded, leads the float 24 out of the opening of the bush 23, thereby uncovering same for the passage of the gas upwards or the liquid downwards, which impedes the tangling and jamming of the cable 2 in one instance and its breakage, in the other.

During operation in wells with the stepwise variable diameter of the oil well tubings 3, the additional adjusting rings 29 will, on the running-in, be removed one after another and from the outer solid ring 25 and will be left inside the oil well tubings 3 at the points of transition of the diameter from larger to smaller one. On lifting, said additional adjusting rings 29 will in reverse order return to the initial position, retaining the selected width of said ring-shaped gap 6 invariable.

We claim:

1. A process for raising a liquid from a well, comprising the steps of:

determining a production rate for the well in which $Q_1$=liquid flow rate in $m^3$/sec, and $Q_g$=gas flow rate in $m^3$/sec, using a device for raising a liquid, said device having the outer diameter thereof smaller than the inner diameter of a lift tubing string arranged to be disposed in the well, whereby an annular clearance is defined between an internal wall of said lift tubing string and an external wall of said device, the area of said clearance making up less than 25% of a flow-section area of said lift tubing string, periodically lowering said device for raising a liquid on a cable down into said lift tubing string to a depth determined by the technical characteristics of a hoisting apparatus and by the technological mode of operation of the well, capturing a liquid by said device from said lift tubing string, and lifting said device along said lift tubing string on said cable, and raising said liquid captured above said device under the influence of pressure exerted by gas which is in said lift tubing string beneath said device, wherein a lifting speed, V in m/sec, of said device is defined by the following ratio:

$$\frac{Q_1}{F} < V < \frac{Q_1 + Q_g - Q_{d.ch.}}{F}$$

where F=internal cross-sectional area of said lift tubing string, $m^2$; and $Q_{d.ch}$·=dynamic characteristic of said device for raising a liquid, said characteristic defining a quantity of gas as required to prevent a return flow of the liquid which is above said device, $m^3$/sec.

2. The process as claimed in claim 1, wherein a flow of gas leaving the well is inhibited while said device for raising a liquid from a well is lowered down along said lift tubing string.

3. The process as claimed in claim 1, wherein the speed of lifting said device on the cable is increased in a range of from 2 to 3 times as soon as the liquid thus raised begins to overflow through the well head.

4. The process as claimed in claim 1, wherein the lifting of said device is discontinued after more than 10% of the height of a column of the liquid thus raised overflows through the well head.

5. The process as claimed in claim 1, wherein a successive lowering of said device down into said lift tubing string is started before all the liquid raised during a previous trip thereof overflows through the well head.

6. A device for raising a liquid from a well, comprising:

a perforated cylindrical body having two bases which are provided each with a central opening, a guide rod extending along a longitudinal axis of the body, said guide rod having the ends thereof rigidly fixed in said openings provided in said bases of the body, a check valve arranged in said body within a middle portion thereof and having a valve housing rigidly connected to said body and a valve plug which is mounted on said guide rod so as to be capable of being moved along the longitudinal axis of said body on said rod, a removable ring for setting a clearance between an external surface of said body and an internal surface of a lift tubing string installed in said well, said ring having an inner diameter thereof equal to an outer diameter of said body, and an outer diameter thereof somewhat smaller than an inner diameter of said lift tubing string, said ring being located on the external surface of said body and rigidly connected thereto, a first means for centering said body inside said lift tubing string, said first means being disposed on one side of said body and secured to one of said bases, a second means for centering said body inside said lift tubing string, said second means being secured to the second one of said bases of said body, and a means for connecting to a cable for lowering down and lifting up said device along said lift tubing string, said connecting means being secured to said means for centering said body.

7. The device as claimed in claim 6, wherein said body is made in the form of a lattice.

8. The device as claimed in claim 6, wherein said valve plug is made to be spring-loaded.

9. A device for raising a liquid from a well, comprising:

a perforated cylindrical body having a base, a check valve arranged in said body within a portion thereof facing a bottom of said well and having a valve housing rigidly connected to said body and a valve plug which is mounted so as to be capable of being moved along the longitudinal axis of said body, a removable ring for setting a clearance between an external surface of said body and an internal surface of a lift tubing string installed in said well, said ring having an inner diameter thereof equal to an outer diameter of said body, and an outer diameter thereof somewhat smaller than an inner diameter of said lift tubing string, said ring being located on the external surface of said body and rigidly connected thereto, a first means for centering said body inside said lift tubing string, said first means being disposed on one side of said body and secured to said base, a second means for centering said body inside said lift tubing string, said second means being secured to said first means for centering said body, and a means for connecting to a cable for lowering down and lifting up said device along said lift tubing string.

10. The device as claimed in claim 9, wherein said first means for centering said body and said second means for centering said body are secured to said body on the side thereof facing the well head of said well, and wherein said means for connecting to a cable is secured to said second means for centering said body.

11. The device as claimed in claim 9, wherein said first means for centering said body and said second means for centering said body are secured to said body on the side thereof facing the bottom of said well, and wherein said means for connecting to a cable is secured to said base of said body, said base facing the well head of said well.

12. The device as claimed in claim 11, wherein further there is art least one ring designed to be used in a well having a stepwise varying diameter of said lift tubing string and disposed on the external surface of said removable ring, and wherein a longitudinal movement of said further ring is restricted by a shoulder provided on said removable ring.

13. A device for raising a liquid from a well, comprising:

a hollow bar having a number of openings in the side wall thereof, a check valve arranged on said hollow bar and having a valve housing configured as a cone and rigidly connected to said bar, and a valve plug designed for setting a clearance between an internal surface of said lift tubing string installed in said well and an external surface of said valve plug, said valve plug being mounted so as to be capable of being moved along the longitudinal axis of said hollow bar, said opening being located above said check valve, a first means for centering said hollow bar inside said lift tubing string, said first means being disposed on one side of said check valve, a second means for centering said hollow bar inside said lift tubing string, said second means being secured to said hollow bar on the opposite side with respect to said valve plug of said check valve, liquid store secured to said hollow bar on the side thereof facing the lower portion of said well, a third means for centering said hollow bar inside said lift tubing string and secured to said liquid store, and a means for connecting to a cable for lowering down and lifting up said device, said connecting means being secured to said hollow bar on the side thereof facing the well head of said well.

* * * * *